US006708343B1

(12) United States Patent
Ceron

(10) Patent No.: US 6,708,343 B1
(45) Date of Patent: Mar. 23, 2004

(54) COMBINATION CUSHION, CARRY DEVICE, AND GARMENT APPARATUS

(76) Inventor: Gloria Ceron, 33 N. Franklin St., Richwood, OH (US) 43344

( * ) Notice: Subject to any disclaimer, the term of this patent is extended or adjusted under 35 U.S.C. 154(b) by 0 days.

(21) Appl. No.: 10/307,084

(22) Filed: Nov. 27, 2002

(51) Int. Cl.[7] ..... A41D 3/08
(52) U.S. Cl. ..... 2/88; 2/84; 5/417
(58) Field of Search ..... 2/69, 84–89, 202, 2/209.11, 114, 94, 125, 69.5; 383/4; 5/417–420, 482, 485, 653, 495, 652; 224/575, 577

(56) References Cited

U.S. PATENT DOCUMENTS

| | | | | | |
|---|---|---|---|---|---|
| 2,109,951 | A | | 3/1938 | Truesdell et al. | |
| 2,783,473 | A | | 3/1957 | Humpeler | |
| 2,967,306 | A | | 1/1961 | Fabanich | |
| 4,316,288 | A | * | 2/1982 | Henrickson | 2/88 |
| 4,370,755 | A | | 2/1983 | Crumby | |
| 5,414,881 | A | | 5/1995 | Terrazas | |
| 5,454,125 | A | | 10/1995 | Ratkowski | |
| 5,463,783 | A | | 11/1995 | Pope | |
| 5,664,258 | A | * | 9/1997 | Harris | 2/84 |
| 5,787,504 | A | | 8/1998 | Wu | |
| 5,884,331 | A | | 3/1999 | Barajas | |
| 5,901,375 | A | * | 5/1999 | Davis | 2/84 |
| 5,920,931 | A | | 7/1999 | Zuehlke et al. | |
| 6,223,367 | B1 | | 5/2001 | French et al. | |
| 6,243,873 | B1 | * | 6/2001 | Aliff | 2/88 |
| 6,341,379 | B1 | * | 1/2002 | Kokus | 2/89 |

* cited by examiner

*Primary Examiner*—Tejash Patel
(74) *Attorney, Agent, or Firm*—David J. Dawsey; Michael J. Gallagher; Gallagher and Dawsey Co LPA

(57) ABSTRACT

A combination cushion, carry device, and garment apparatus for use as a protective weather resistant garment, blanket, pillow, seat cushion, and transport device. The apparatus has, among other elements, a planar member, a hood, a right sleeve, a left sleeve, a waistband retainer, a carrying system, and a pouch. The sleeves are attached to the apparatus with sleeve attachment devices that allow for a broad range of motion while minimizing the loss of coverage associated with traditional ponchos. The entire apparatus may be folded, rolled, or bunched, for storage and transport in the pouch. The carrying system is attached to the planar member and serves dual functions. The carrying system acts both as a convenient adjustable method of carrying the apparatus during transport and as a method of adjustably securing the apparatus to the body when worn as a garment.

20 Claims, 8 Drawing Sheets

COMBINATION CUSHION, CARRY DEVICE, AND GARMENT APPARATUS

TECHNICAL FIELD

The present invention relates to the field of multi-purpose articles; particularly, to a device that conveniently serves as a combination cushion, carrying, and storage device, and garment to protect one from the environment.

BACKGROUND OF THE INVENTION

Active people often find themselves in need of garments and accessories to protect themselves from the weather as well as increase one's general comfort in the outdoors. Generally these garments and accessories are bulky, cumbersome, and often interfere with a person's enjoyment of outdoor activities.

Fall evening football games are just one of many examples of when such garments and accessories are desirable. For example, a person attending such game will commonly bring with them an additional coat, a blanket, a seat cushion, a waterproof poncho and/or umbrella, gloves, a hat, ear muffs, and a large bag to carry all these items. These items are often forgotten prior to attending the game resulting in a less enjoyable viewing experience, or inadvertently left behind when leaving the event.

Previous attempts have been made to conveniently combine such articles. Numerous prior art attempts have included blankets, that may be used as a covering, that fold up into a self-contained carrying device, and that are sometimes used as a pillow. Such attempts include U.S. Pat. No. 5,414,881 to Terrazas, U.S. Pat. No. 5,454,125 to Ratkowski, U.S. Pat. No. 5,884,331 to Barajas, and U.S. Pat. No. 5,920,931 to Zuehlke et al., among others. Additionally, numerous prior art attempts have included poncho type personal coverings that may be folded to create a seat cushion, or may contain an independent seat cushion. Such attempts include U.S. Pat. No. 2,967,306 to Favanich, U.S. Pat. No. 4,370,755 to Crumby, and U.S. Pat. No. 5,463,783 to Pope.

Such devices may be relatively effective when the user is sedentary, but are generally ineffective when the user is involved in frequent motion. For example, blanket and body wrap type coverings must be draped over one's shoulders and continuously held against one's body, thus making it difficult to perform tasks that require use of one's arms.

Further, while poncho type personal coverings allow limited use of the arms, this generally comes with increased exposure to the weather. For example, poncho type personal coverings generally drape over the shoulders of the user and accommodate arm movement by leaving the sides of the user exposed to the elements. Further, poncho type personal coverings rarely extend down the arm much past the elbow thereby leaving a portion of the user's arms exposed to the elements. In the rare occasions in which a poncho type covering does create arm coverings via fasteners retaining the poncho side slits together, as in U.S. Pat. No. 2,967,306 to Fabanich, the range of motion of a user's arms is very limited and the act of raising one's arms exposes more of the user's legs to the elements.

Such traditional devices as those described above are generally inadequate for the myriad of activities required by outdoor workers and non-sedentary recreational activities. Accordingly, the art has needed a means for providing a weather resistant garment that provides protection from the elements throughout a wide range of motion, while incorporating additional comfort and utility features. While some of the prior art devices attempted to improve the state of the art of personal covering and comfort devices, none has achieved a cost optimized capability that is easy to manufacture and provides comfort and protection from the elements throughout such a wide range of motion. With these capabilities taken into consideration, the instant invention addresses many of the shortcomings of the prior art and offers significant benefits heretofore unavailable. Further, none of the above inventions and patents, taken either singly or in combination, is seen to describe the instant invention as claimed.

SUMMARY OF INVENTION

In its most general configuration, the present invention advances the state of the art with a variety of new capabilities and overcomes many of the shortcomings of prior devices in new and novel ways. In its most general sense, the present invention overcomes the shortcomings and limitations of the prior art in any of a number of generally effective configurations. In one of the many preferable configurations, the combination cushion, carry device, and garment apparatus incorporates, among other elements, a planar member, a hood, a right sleeve, a left sleeve, a waistband retainer, a carrying system, and a pouch.

The flexible planar member incorporates a first surface and an opposing second surface. The first surface is made of a first material and the second surface is made of a second material that may be substantially water repellant. The second surface is exposed to the environmental elements when the apparatus is worn as a garment. Additionally, the planar member is formed with a head opening allowing the user's head and neck to pass from the first surface to the second surface.

A hood may be attached to the second surface located to substantially enclose the head opening with a hood attachment system. The hood attachment system may be a releasably attachment system to allow the hood to be easily affixed and removed from the second surface, or it may be a permanent attachment system achieved in any number of ways, including simply affixing the hood by sewing.

The apparatus further includes a right sleeve and a left sleeve. Each sleeve has an interior surface and an exterior surface. The right sleeve is attached to the first surface with a right sleeve attachment device, and similarly, the left sleeve is attached to the first surface with a left sleeve attachment device. Each attachment device is secured to the respective sleeve at a proximal end, while an elastic cuff is attached to the distal end of each sleeve. The sleeve attachment devices may secure the sleeves to the first surface permanently or releasably.

A waistband retainer attached to the planar member is further included in the apparatus. The waistband retainer acts in conjunction with a carrying system to releasably secure the apparatus around the body of the user. The waistband retainer may take the form of numerous embodiments. One such embodiment includes a right waistband member and a left waistband member. The right waistband member being secured to the right edge of the apparatus and the left waistband member being secured to the left edge of the apparatus. The right and left waistband members may be joined together simply by tying them together or through the use of a waistband adjustment device. The waistband adjustment device may take the form of virtually any adjustable joining system including, but not limited to, dual ring systems, hook and pile fasteners, hole and pin systems, and quick-release retaining systems.

The carrying system is attached to the planar member and serves dual functions. The carrying system acts both as a convenient adjustable method of carrying the apparatus during transport and as a method of adjustably securing the apparatus to the body when worn as a garment. The carrying system may take the form of numerous embodiments. One such embodiment includes a right carry member and a left carry member. The right carry member being secured to the right edge of the apparatus and the left carry member being secured to the left edge of the apparatus. The right and left carry members may be joined together simply by tying them together or through the use of a carry adjustment device. The carry adjustment device may take the form of virtually any adjustable joining system including, but not limited to, dual ring systems, hook and pile fasteners, hole and pin systems, and quick-release retaining systems.

In securing the apparatus to the body, the waistband retainer generally serves to first secure the front of the apparatus around to the lower back of the user. Once secured, the front of the apparatus is wrapped substantially around the sides and rear of the user. The rear of the apparatus is then wrapped around to the front of the user and secured using the carrying system. Therefore, a substantial portion of the user is wrapped with two layers of the apparatus. Once secure, the apparatus forms a close fit around the sleeves thus minimizing discomfort due to drafts and wind driven elements.

The apparatus further includes a pouch for receiving and transporting the planar member when not in use. Additionally, when the apparatus is within the pouch it may serve as a seat cushion and pillow. Generally, the pouch may be located anywhere along the perimeter of the planar member and on either surface.

The pouch generally consists of a planar body that may be any number of geometric configurations provided a predetermined volume, sufficient to contain the apparatus, is obtained. In one such embodiment, the planar body is substantially rectangular having a first edge, a second edge, a third edge, and a fourth edge. The first edge is generally attached to the planar member near the perimeter with the second and third edges attached to the planar member substantially perpendicular to the first edge. The fourth edge is generally not attached to the second surface thereby leaving an open end to accept the rolled, stuffed, or folded apparatus.

Further embodiments of the apparatus include a number of convenience accessories. One such convenience accessory is a hand warming compartment attached to the planar member. Further, the apparatus may include at least one pocket. Additionally, at least one accessory attachment device may be attached to the apparatus to provide a convenient method of securing items such as mittens, gloves, keys, and ear muffs to the apparatus.

Numerous other variations of the apparatus may include features specifically tailored to unique applications. For instance, a variation of the apparatus may be directed toward automobile emergency safety and include at least one reflective indicia. Additionally, such a variation may include pockets for containing jumper cables, tire puncture repair kits, air pressure gauges, ice scrapers, and any number of related automobile accessories. Similar variations may be directed toward skiers, snowmobile riders, motorcyclists, firefighters, police, emergency medical technicians, and their associated equipment.

These variations, modifications, alternatives, and alterations of the various preferred embodiments, arrangements, and configurations may be used alone or in combination with one another as will become more readily apparent to those with skill in the art with reference to the following detailed description of the preferred embodiments and the accompanying figures and drawings.

BRIEF DESCRIPTION OF THE DRAWINGS

Without limiting the scope of the present invention as claimed below and referring now to the drawings and figures:

Figure 1:
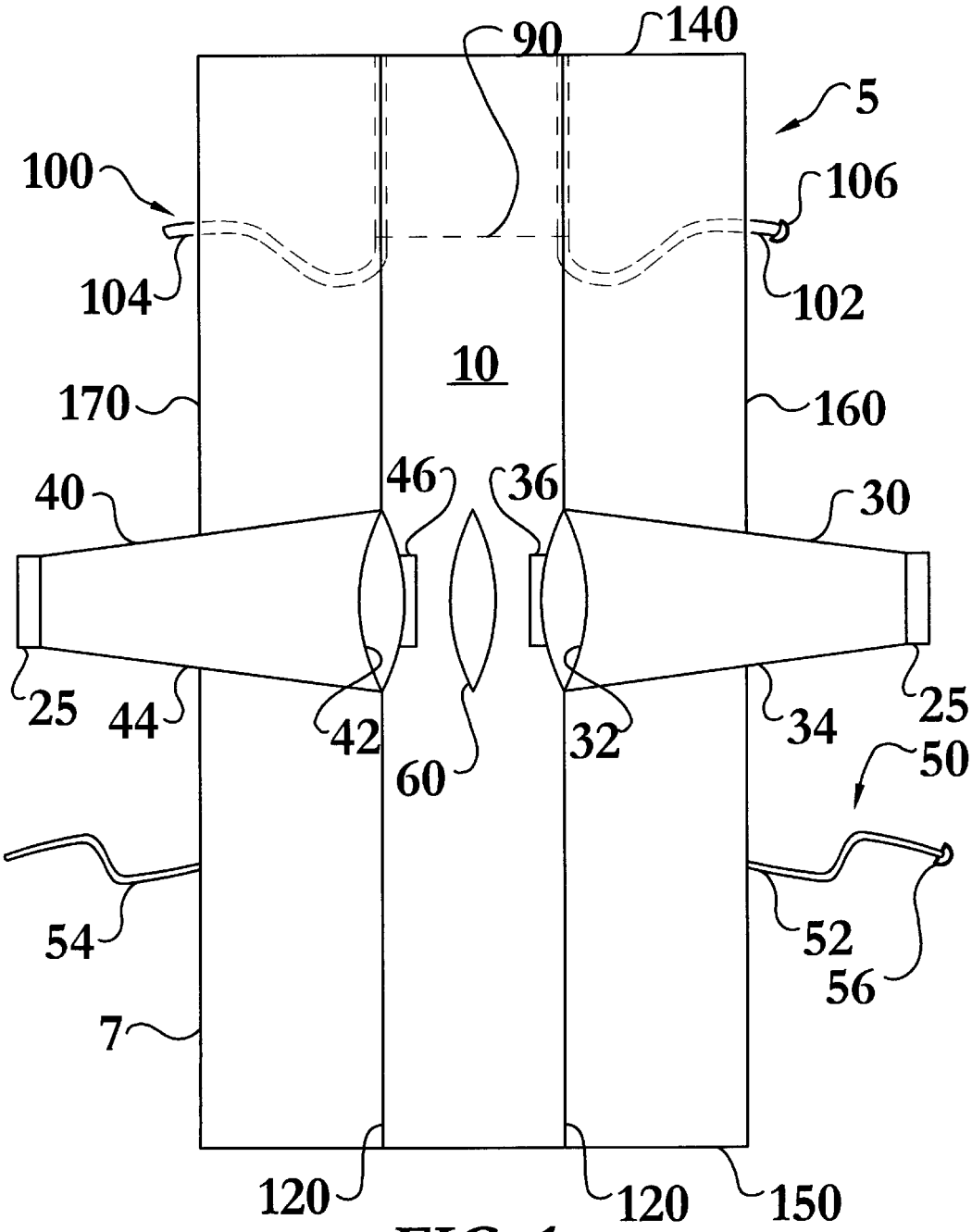
FIG. 1 shows a combination cushion, carry device, and garment apparatus wherein the components are shown in bottom plan view, in reduced scale.

Also, in the various figures and drawings, the following reference symbols and letters are used to identify the various elements described herein below in connection with the several figures and illustrations: F and T.

DESCRIPTION OF THE INVENTION

The combination cushion, carry device, and garment apparatus of the instant invention enables a significant advance in the state of the art. The preferred embodiments of the apparatus accomplish this by new and novel arrangements of elements that are configured in unique and novel ways and which demonstrate previously unavailable but preferred and desirable capabilities.

The detailed description set forth below in connection with the drawings is intended merely as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention.

With reference generally now to FIGS. 1 through 10, in one of the many preferable configurations, the combination cushion, carry device, and garment apparatus 5 incorporates, among other elements, a planar member 7, a hood 70, a right sleeve 30, a left sleeve 40, a waistband retainer 50, a carrying system 100, and a pouch 90.

Figure 2:
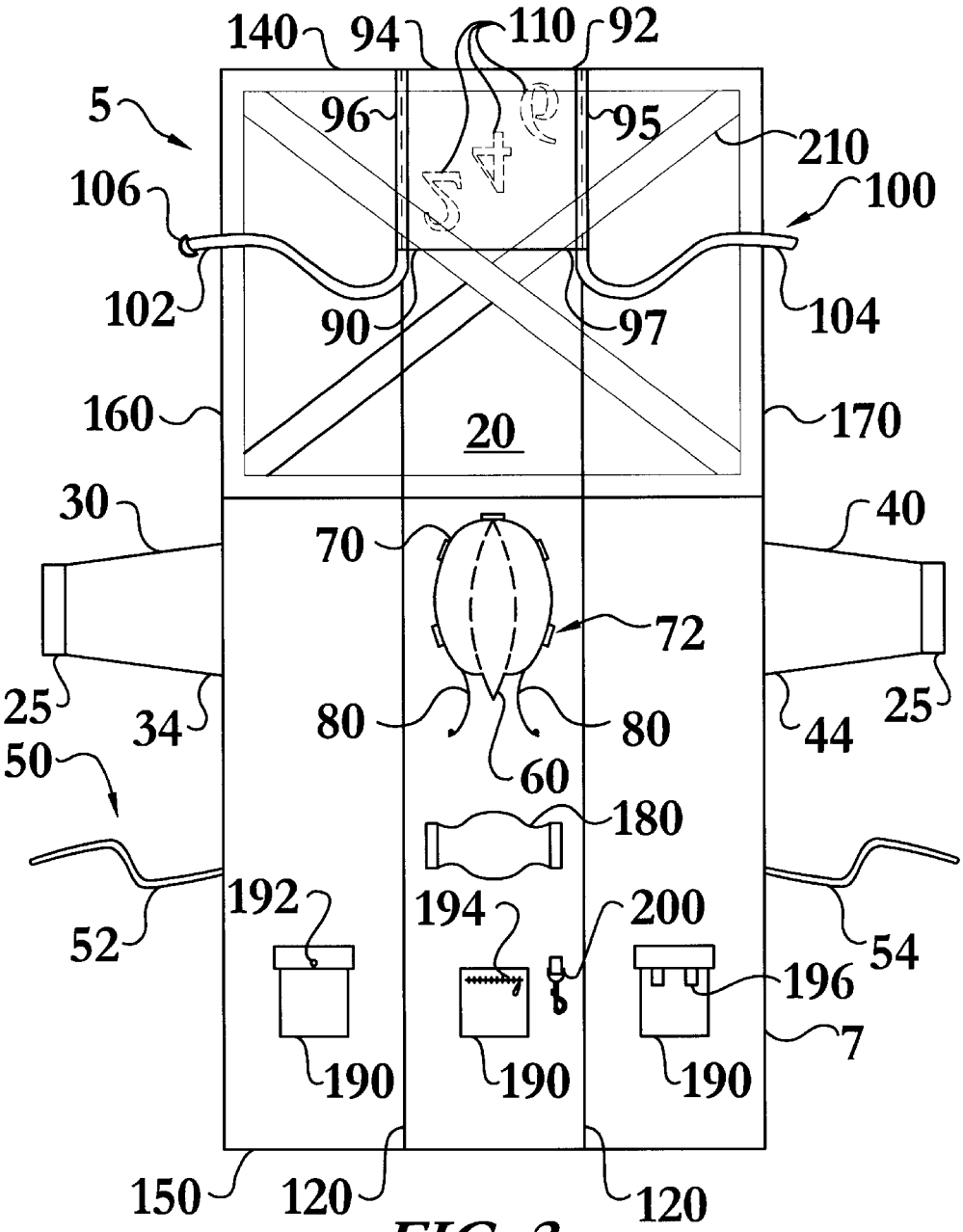
FIG. 2 shows a combination cushion, carry device, and garment apparatus of FIG. 1 wherein the components are shown in top plan view, in reduced scale.
Figure 3:
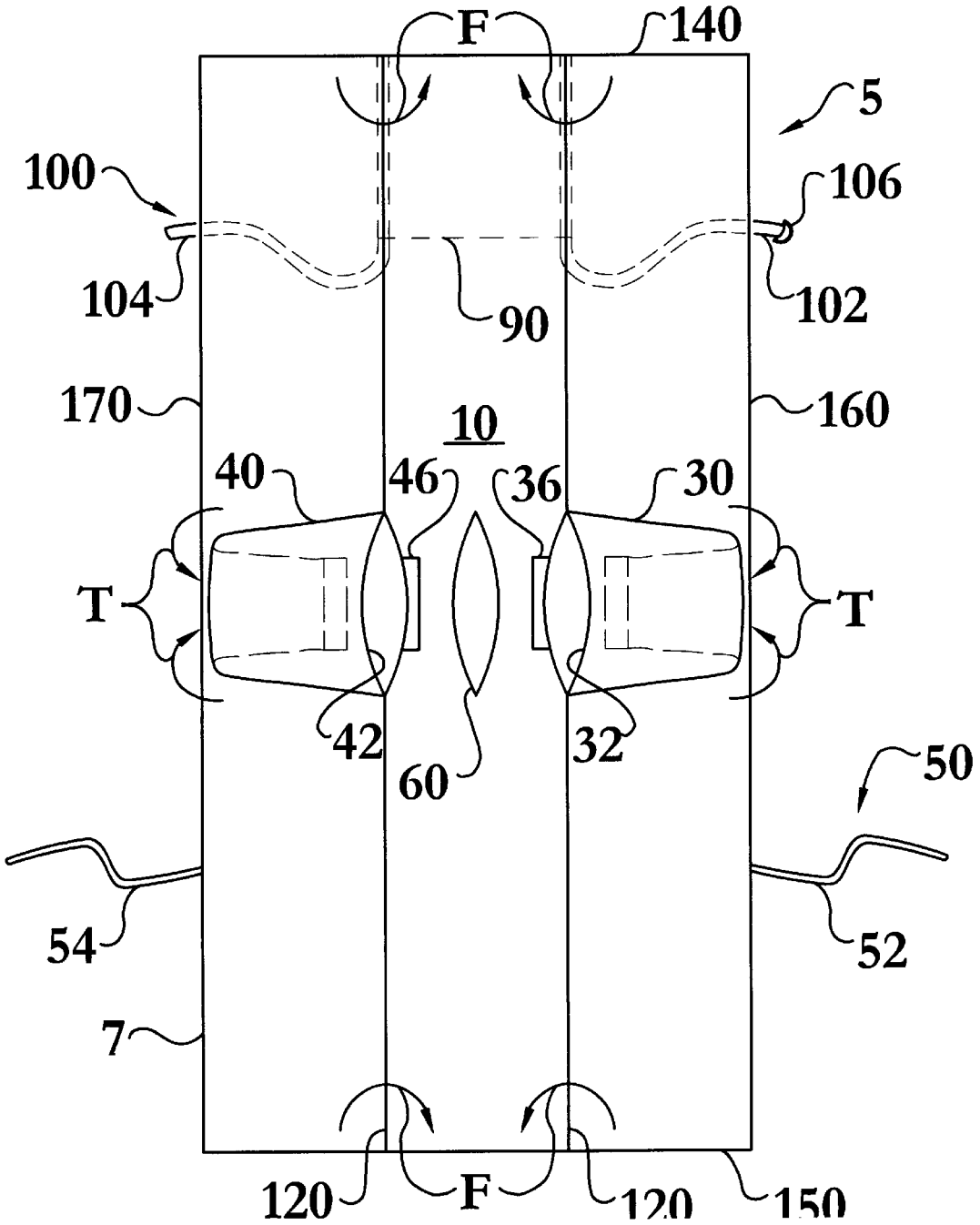
FIG. 3 shows a combination cushion, carry device, and garment apparatus of FIG. 1 wherein the components are shown in bottom plan view, in reduced scale.

Referring now specifically to FIG. 1 and FIG. 2, the flexible planar member 7 incorporates a first surface 10 and an opposing second surface 20. The first surface 10 is made of a first material and the second surface 20 is made of a second material that may be substantially water repellant. The second surface 20 is exposed to the environmental elements when the apparatus 5 is worn as a garment. Additionally, the planar member 7 is formed with a head opening 60 allowing the user's head and neck to pass from the first surface 10 to the second surface 20.

Figure 8:
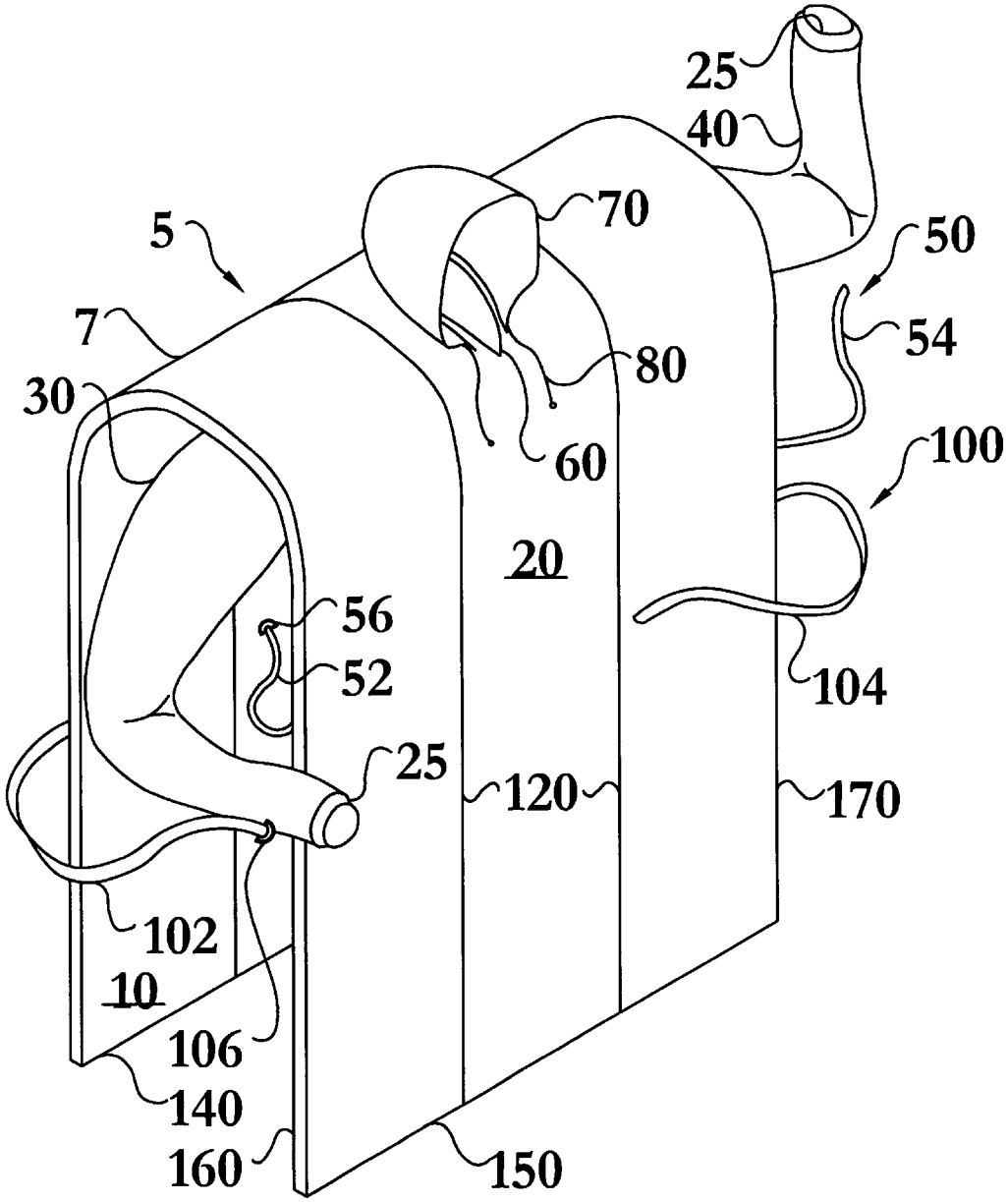
FIG. 8 shows a combination cushion, carry device, and garment apparatus of FIG. 1 wherein the components are shown in front elevated perspective view, in reduced scale.
Figure 9:
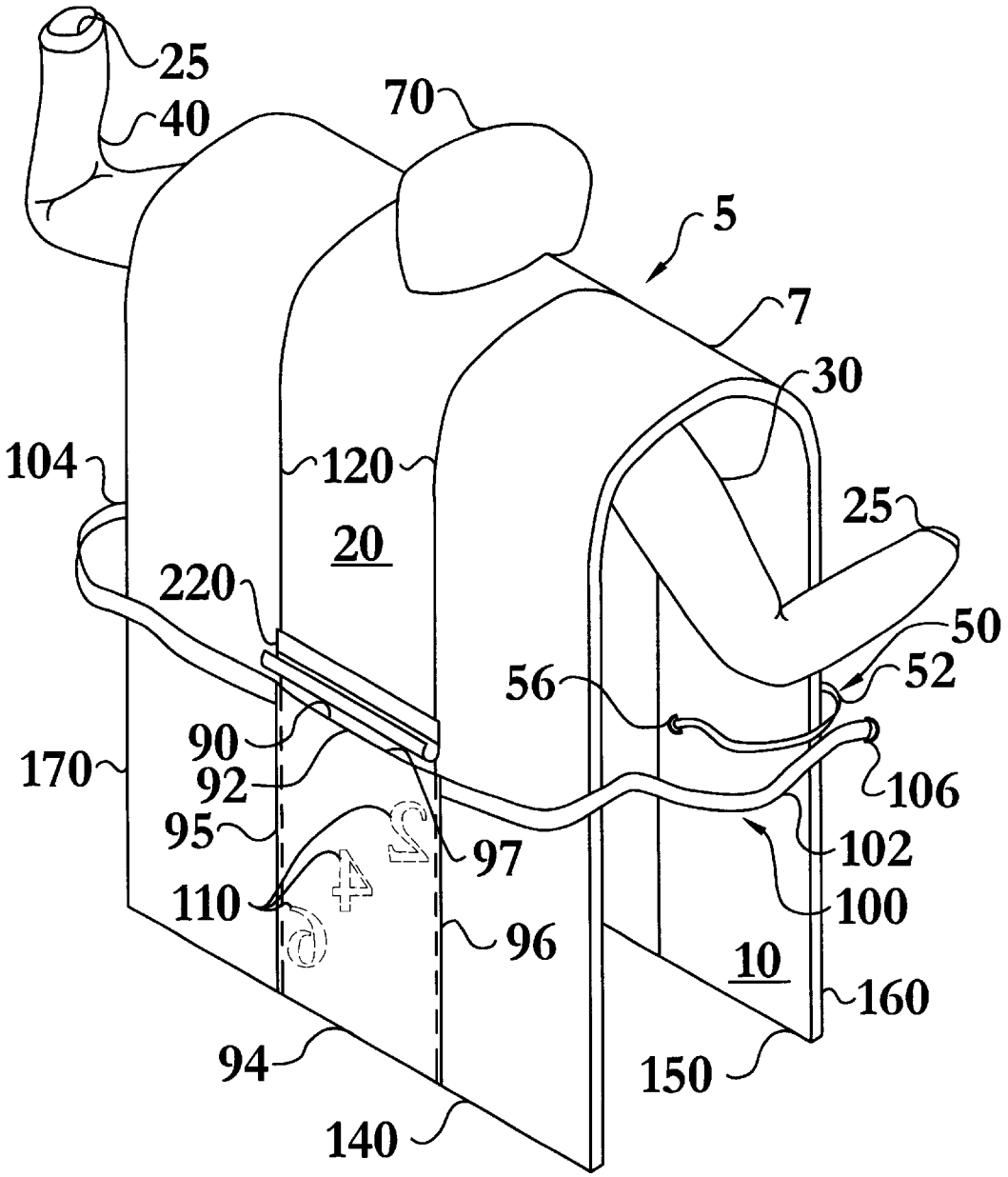
FIG. 9 shows a combination cushion, carry device, and garment apparatus of FIG. 1 wherein the components are shown in rear elevated perspective view, in reduced scale.
Figure 10:
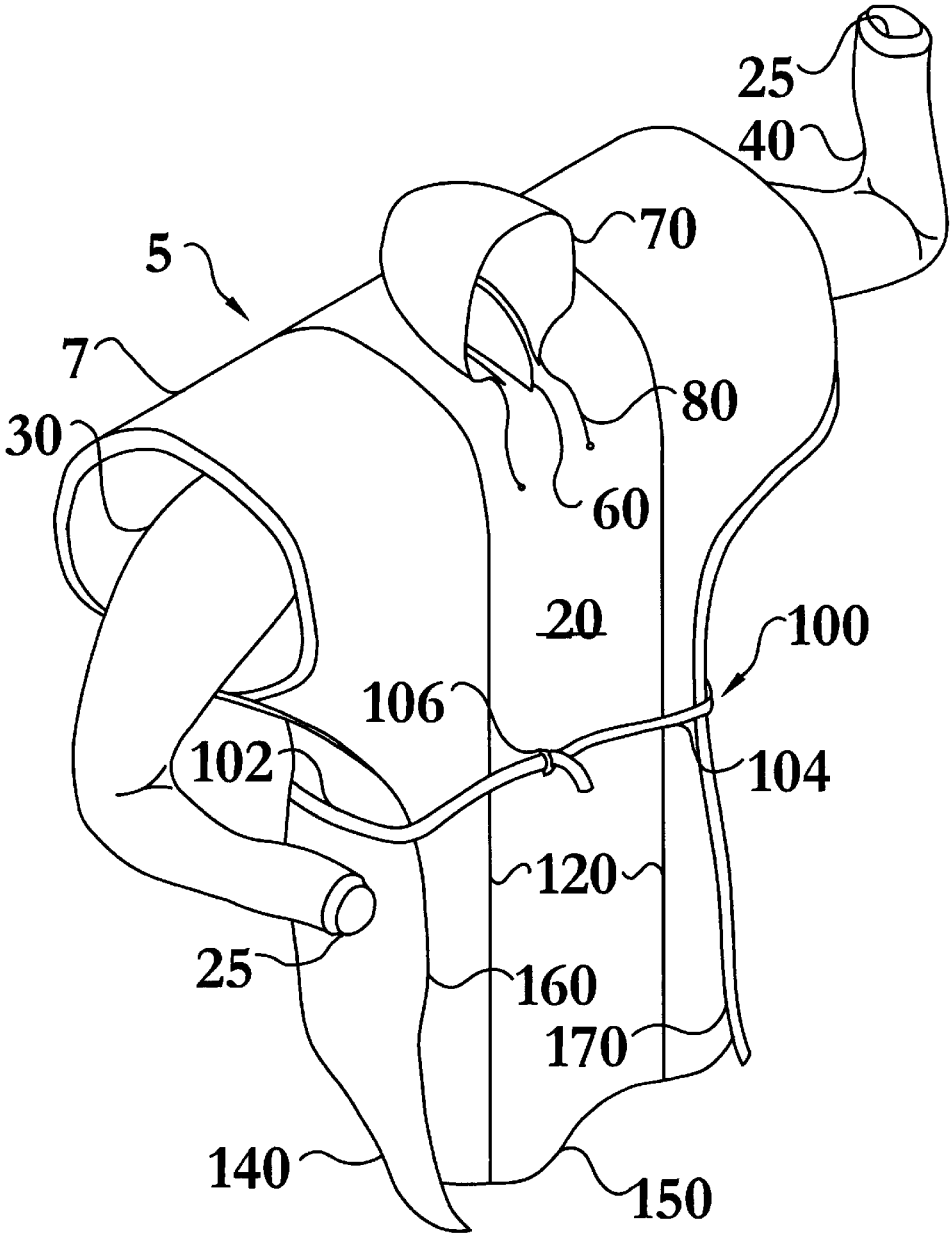
FIG. 10 shows a combination cushion, carry device, and garment apparatus of FIG. 1 wherein the components are shown in front elevated perspective view, in reduced scale.

The planar member 7 is shown in FIG. 1 through FIG. 10 to be substantially rectangular, however it may take virtually any shape. In the substantially rectangular embodiment, the planar member 7 incorporates a top edge 140, a bottom edge 150, a right edge 160, and a left edge 170. The edges 140, 150, 160, 170 are not limited to being straight. In fact, alternative embodiments may incorporate contoured edges such that when the apparatus 5 is wrapped around the user's body the top edge 140 and the bottom edge 150 are substantially parallel to the ground, as shown in FIG. 10.

The second surface 20 of the apparatus 5 may be constructed of any number of materials including, but not limited to, nylon, Dacron®, Goretex®, and polyester, which may be water resistant. Similarly, the first surface 10 may be constructed of any number of material including, but not limited to, flannel, cotton, cotton blends, and terry cloth.

Referring now to FIG. 2, the hood 70 may be attached to the second surface 20 located to substantially enclose the head opening 60 with a hood attachment system 72. The hood attachment system 72 may be a releasably attachment system to allow the hood 70 to be easily affixed and removed from the second surface 20, or it may be a permanent attachment system achieved in any number of ways, including simply affixing the hood 70 by sewing. Additionally, the hood 70 may include a hood drawstring 80 to bring the hood 70 in close proximity to the users head. Further, the head opening 60 may include a neck covering extension member similar to a turtleneck.

The apparatus 5 further includes a right sleeve 30 and a left sleeve 40. Referring again to FIG. 1, each sleeve 30, 40 has an interior surface 32, 42 and an exterior surface 34, 44. The right sleeve 30 is attached to the first surface 10 with a right sleeve attachment device 36, and similarly, the left sleeve 40 is attached to the first surface 10 with a left sleeve attachment device 46. Each attachment device 36, 46 is secured to the respective sleeve 30, 40 at a proximal end, while an elastic cuff 25 is attached to the distal end of each sleeve 30, 40. The sleeve attachment devices 36, 46 may secure the sleeves 30, 40 to the first surface permanently or releasably.

In one of the many embodiments wherein the sleeves 30, 40 are permanently attached to the planar member 7, the sleeve attachment devices 36, 46 may simply consist of fiber sewn to the planar member 7 and the sleeves 30, 40. Additionally, when the sleeve attachment devices 36, 46 releasably attach the sleeves 30, 40 to the planar member 7 the sleeve attachment devices 36, 46 may include virtually any fastening system including, but not limited to, hook and pile fasteners, snaps, buckles, zippers, and clips. The sleeve attachment devices 36, 46 preferably attach to a very small section of the sleeves 30, 40 and a very small section of the planar member 7 allowing the sleeves 30, 40 to move in a broad range of motion with minimal effect on the planar member 7, unlike designs in which the sleeves are created from the same membrane as the body of the garment.

Referring now to FIG. 1 and FIG. 8, a waistband retainer 50 attached to the planar member 7 is further included in the apparatus 5. The waistband retainer 50 acts in conjunction with a carrying system 100 to releasably secure the apparatus 5 around the body of the user, as shown in FIG. 10. The waistband retainer 50 may take the form of numerous embodiments. One such embodiment includes a right waistband member 52 and a left waistband member 54. The right waistband member 52 being secured at a proximal end to the right edge 160 of the apparatus 5 and the left waistband member 54 being secured at a proximal end to the left edge 170 of the apparatus 5. The right and left waistband members 52, 54 may be joined together simply by tying the distal ends together or through the use of a waistband adjustment device 56. The waistband adjustment device 56 is generally attached to the distal end of either waistband members 52, 54, however the waistband adjustment device 56 may be attached to either waistband member 52, 54 at any point between the respective proximal end and distal end. The waistband adjustment device 56 may take the form of virtually any adjustable joining system including, but not limited to, dual ring systems, hook and pile fasteners, hole and pin systems, and quick-release retaining systems.

The carrying system 100 is attached to the planar member 7 and serves dual functions. The carrying system 100 acts both as a convenient adjustable method of carrying the apparatus 5 during transport and as a method of adjustably securing the apparatus 5 to the body when worn as a garment. The carrying system 100 may take the form of numerous embodiments. One such embodiment includes a right carry member 102 and a left carry member 104. The right carry member 102 being secured at a proximal end to the right edge 160 of the apparatus 5 and the left carry member 104 being secured at a proximal end to the left edge 170 of the apparatus 5. The right and left carry members 102, 104 may be joined together simply by tying the distal ends together or through the use of a carry adjustment device 106. The carry adjustment device 106 is generally attached to the distal end of either carry members 102, 104, however the carry adjustment device 106 may be attached to either carry member 102, 104 at any point between the respective proximal end and distal end. The carry adjustment device 106 may take the form of virtually any adjustable joining system including, but not limited to, dual ring systems, hook and pile fasteners, hole and pin systems, and quick-release retaining systems. The carrying system 100 may additionally be configured to transport the apparatus 5 as a backpack.

As illustrated in FIG. 8, FIG. 9, and FIG. 10, in securing the apparatus 5 to the body, the waistband retainer 50 generally serves to first secure the front of the apparatus around to the lower back of the user. Once secured, the front of the apparatus is wrapped substantially around the sides and rear of the user. The rear of the apparatus is then wrapped around to the front of the user and secured using the carrying system 100. Therefore, a substantial portion of the user is wrapped with two layers of the apparatus. Once secure, the apparatus forms a close fit around the sleeves 30, 40 thus minimizing discomfort due to drafts and wind driven elements.

As shown in FIG. 2 and FIG. 9, the apparatus 5 further includes a pouch 90 for receiving and transporting the planar member 7 when not in use. Additionally, when the apparatus 5 is within the pouch 90 it may serve as a seat cushion and pillow. Generally, the pouch 90 may be located anywhere along the perimeter of the planar member 7 and on either surface 10, 20.

The pouch 90 generally consists of a planar body 92 that may be any number of geometric configurations provided a predetermined volume, sufficient to contain the apparatus 5, is obtained. In one such embodiment, the planar body 92 is substantially rectangular having a first edge 94, a second edge 95, a third edge 96, and a fourth edge 97. The first edge 94 is generally attached to the planar member 7 near the perimeter with the second 95 and third edges 96 attached to the planar member 7 substantially perpendicular to the first edge 94. The fourth edge 97 is generally not attached to the second surface 20 thereby leaving an open end to accept the rolled or folded apparatus.

In one particular embodiment, shown in FIG. 2, the first edge 94 is attached to the second surface 20 at substantially a midpoint of the top edge 140. In this embodiment, the pouch 90 is inverted, or inside out, when the apparatus 5 is unfolded in garment form, as shown indicated by the mirror image of the indicia 110 shown in FIG. 2, FIG. 6, and FIG. 9.

Figure 4:
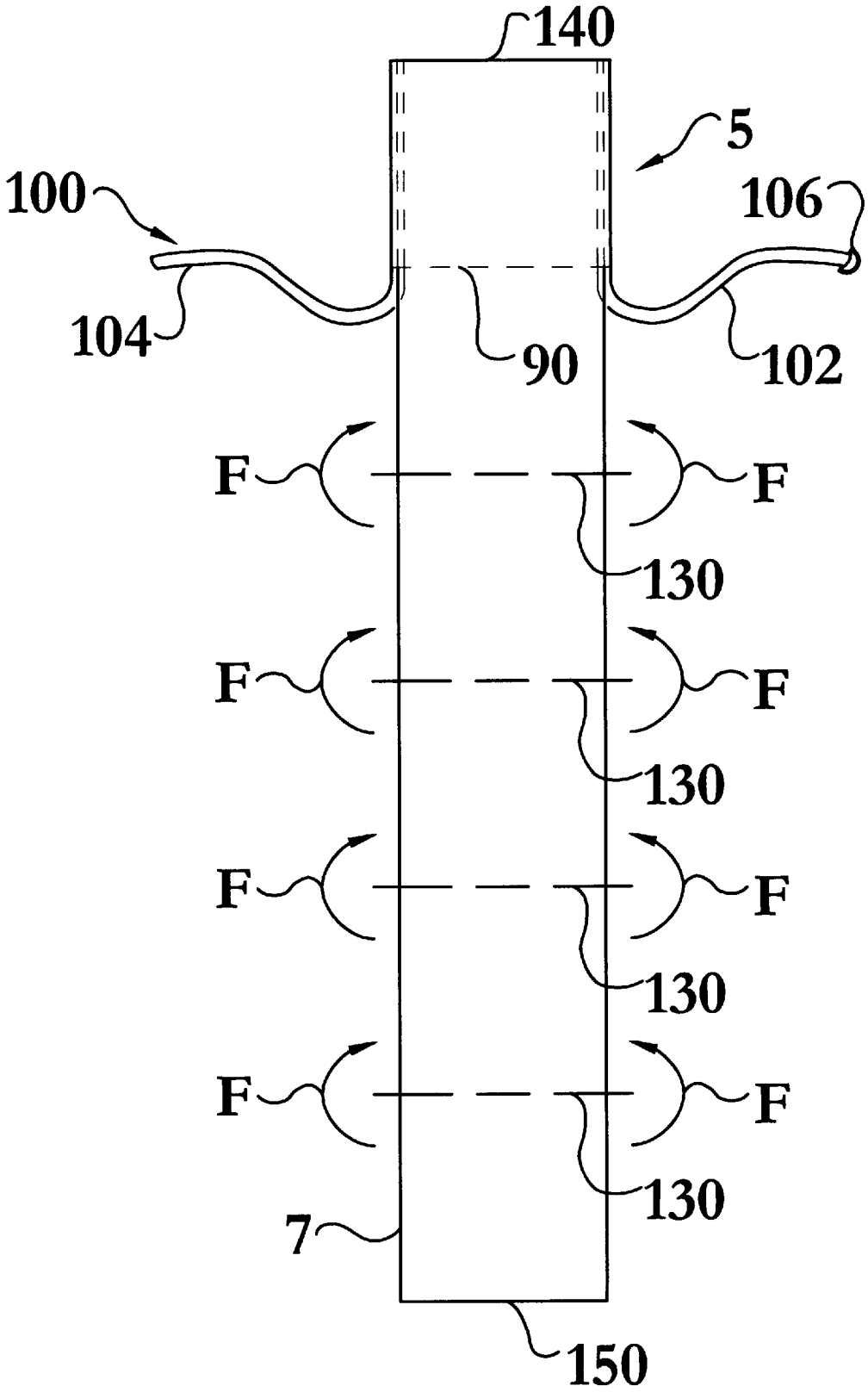
FIG. 4 shows a combination cushion, carry device, and garment apparatus of FIG. 1 wherein the components are shown in bottom plan view, in reduced scale.
Figure 5:
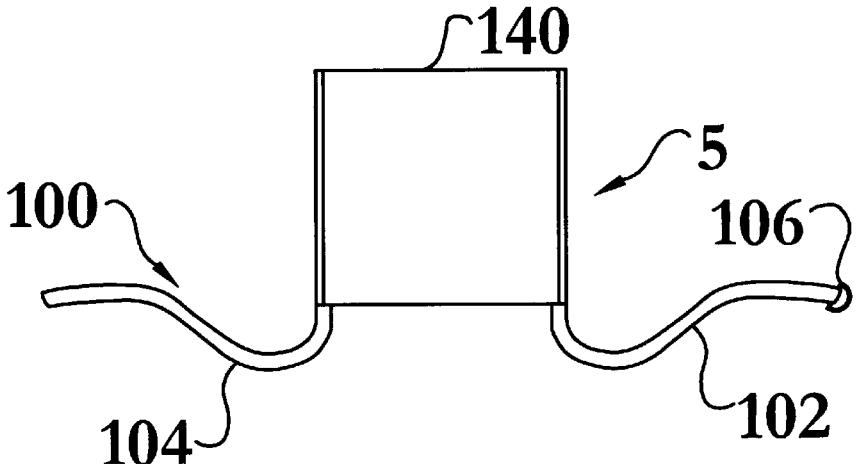
FIG. 5 shows a combination cushion, carry device, and garment apparatus of FIG. 1 wherein the components are shown in bottom plan view, in reduced scale.
Figure 6:
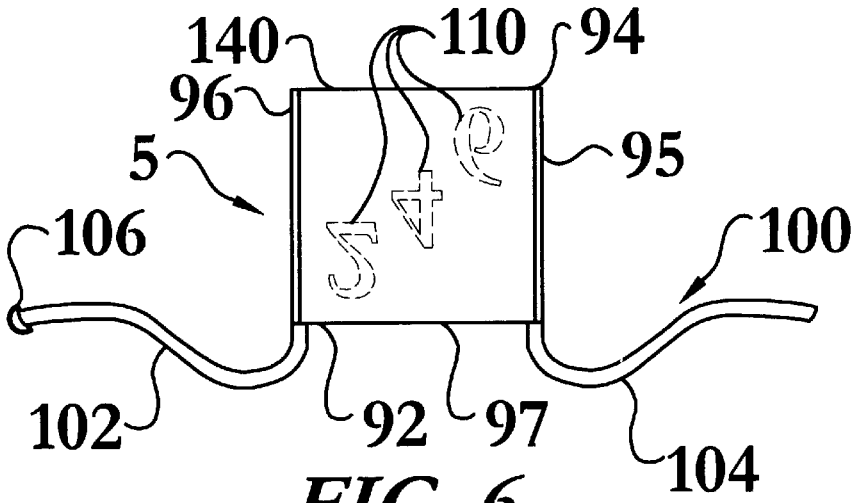
FIG. 6 shows a combination cushion, carry device, and garment apparatus of FIG. 1 wherein the components are shown in top plan view, in reduced scale.
Figure 7:
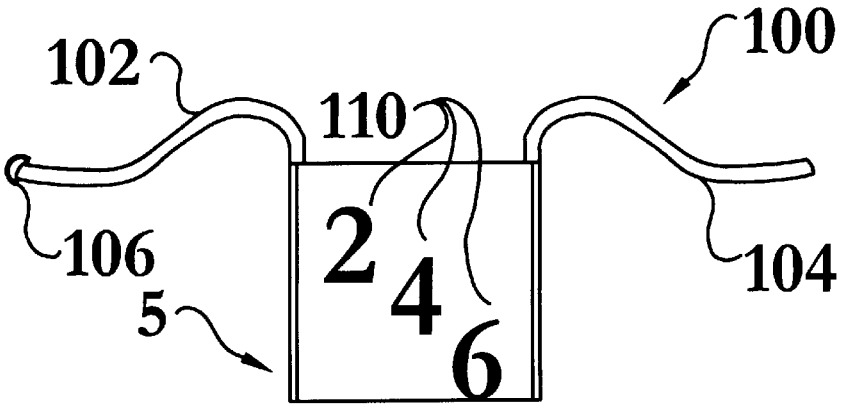
FIG. 7 shows a combination cushion, carry device, and garment apparatus of FIG. 6 where the pouch has been inverted to enclose the apparatus, wherein the components are shown in top plan view, in reduced scale.

The apparatus 5 may be conveyed into the pouch 90 in a number of ways. One particular method is illustrated in FIG. 3 through FIG. 7. In this method, the sleeves 30, 40 are first tucked inside themselves illustrated by reference letter T indicating the tucking motion in FIG. 3. The planar member is then folded, illustrated by reference letter F indicating the direction of the fold, generally along vertical fold lines 120, which may be imaginary or actual seams in the planar member 7. Referring now to FIG. 4, the planar member 7 may then be folded along horizontal fold lines 130 resulting in the apparatus 5 as shown in FIG. 5. The rear view of FIG. 5 is shown in FIG. 6, illustrating the pouch 90, and indicia 110, in the inverted position. The pouch 90 is then turned inside out enclosing the apparatus 5 and resulting in the normal display of the indicia 110, as shown in FIG. 7.

The apparatus 5 may further include a pouch flap 220 as shown in FIG. 9. In embodiments wherein the pouch 90 is located on the second surface 20, the pouch flap 220 acts to cover the inlet to the pouch 90 to prevent rain, snow, and other articles from entering the pouch 90 when it is worn as a garment.

In the state shown in FIG. 7, the apparatus 5 may serve a number of functions. The apparatus may serve as a seat cushion, pillow, purse, or carry bag. The apparatus 5 may further be outfitted with internal and external pockets for containing articles for transport.

Referring now to FIG. 2, further embodiments of the apparatus 5 include a number of convenience accessories. One such convenience accessory is a hand warming compartment 180 attached to planar member 7. Further, the apparatus 5 may include at least one pocket 190. The at least one pocket 190 may include any number of closure devices including, but not limited to, snap closures 192, zipper closures 194, and hook and pile closures 196. Additionally, at least one accessory attachment device 200 may be attached to the apparatus 5 to provide a convenient method of securing items such as mittens, gloves, keys, and ear muffs to the apparatus.

Numerous other variations of the apparatus 5 may include features specifically tailored to unique applications. For instance, a variation of the apparatus may be directed toward automobile emergency safety and include at least one reflective indicia. Additionally, such a variation may include pockets for containing jumper cables, tire puncture repair kits, air pressure gauges, ice scrapers, and any number of related automobile accessories. Similar variations may be directed toward skiers, snowmobile riders, motorcyclists, firefighters, police, emergency medical technicians, and their associated equipment. Such variations may include detachable pants and individual detachable leg coverings, similar to the individually detachable sleeves 30, 40 previously disclosed. Additionally, any of the embodiments of the apparatus 5 may incorporate at least one reflective indicia 210 to increase the wearer's safety, as illustrated in FIG. 2. Such indicia 210 may include messages such as "call police" and "need help."

Numerous alterations, modifications, and variations of the preferred embodiments disclosed herein will be apparent to those skilled in the art and they are all anticipated and contemplated to be within the spirit and scope of the instant invention. For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the present invention are described herein, it is to be understood that the practice of such additional modifications and variations and the equivalents thereof, are within the spirit and scope of the invention as defined in the following claims.

I claim:

1. A combination cushion, carry device, and garment apparatus, comprising:

a flexible planar member, having a first surface, made of a first material, and a second surface, made of a second material, wherein the planar member is formed with a head opening;

a hood attached to the second surface, substantially enclosing the head opening, with a hood attachment system;

a right sleeve, having an interior surface, an exterior surface, and a distal elastic cuff, proximally attached to the first surface with a right sleeve attachment device;

a left sleeve, having an interior surface, an exterior surface, and a distal elastic cuff, proximally attached to the first surface with a left sleeve attachment device;

a waistband retainer attached to the planar member;

a carrying system attached to the planar member; and a pouch, for receiving the planar member when folded, rolled, or bunched, attached to the planar member at a predetermined location.

2. The apparatus according to claim 1, wherein the carrying system includes a right carry member and a left carry member.

3. The apparatus according to claim 2, further including a carry adjustment device.

4. The apparatus according to claim 1, wherein the right sleeve attachment device releasably attaches the right sleeve to the first surface and the left sleeve attachment device releasably attaches the left sleeve to the first surface.

5. The apparatus according to claim 1, wherein the waistband retainer includes a right waistband member and a left waistband member.

6. The apparatus according to claim 5, further including a waistband adjustment device.

7. The apparatus according to claim 1, further including a hand warming compartment attached to the planar member.

8. The apparatus according to claim 1, further including at least one pocket attached to the planar member.

9. The apparatus according to claim 1, further including at least one accessory attachment device attached to the planar member.

10. The apparatus according to claim 1, further including at least one reflective indicia attached to the planar member.

11. A combination cushion, carry device, and garment apparatus, comprising:

a substantially rectangular flexible planar member formed with a substantially centrally located head opening, having (a) a first surface, made of a first material, (b) a second surface, made of a second material, (c) a top edge, (d) a bottom edge substantially parallel with the top edge, (e) a right edge, and (f) a left edge substantially parallel with the right edge;

a hood attached to the second surface, substantially enclosing the head opening, with a hood attachment system;

a right sleeve, having an interior surface, an exterior surface, and a distal elastic cuff, proximally attached to the first surface with a right sleeve attachment device;

a left sleeve, having an interior surface, an exterior surface, and a distal elastic cuff, proximally attached to the first surface with a left sleeve attachment device;

a waistband retainer attached to the planar member;

a carrying system attached to the planar member; and a pouch, for receiving the planar member when folded, rolled, or bunched, by inverting the pouch, consisting of a substantially rectangular planar body having a first edge, a second edge, a third edge, and a fourth edge, wherein the first edge is attached to the second surface at substantially a midpoint of the top edge, the second edge is attached to the second surface in an orientation that is substantially parallel to the left edge, the third edge is attached to the second surface in an orientation that is substantially parallel to the right edge, and the fourth edge is not attached to the second surface.

12. The apparatus according to claim 11, wherein the carrying system includes a right carry member and a left carry member.

13. The apparatus according to claim 12, further including a carry adjustment device.

14. The apparatus according to claim 11, wherein the right sleeve attachment device releasably attaches the right sleeve to the first surface and the left sleeve attachment device releasably attaches the left sleeve to the first surface.

15. The apparatus according to claim 11, wherein the waistband retainer includes a right waistband member and a left waistband member.

16. The apparatus according to claim 15, further including a waistband adjustment device.

17. The apparatus according to claim 11, further including a hand warming compartment attached to the planar member.

18. The apparatus according to claim 11, further including at least one pocket attached to the planar member.

19. The apparatus according to claim 11, further including at least one accessory attachment device attached to the planar member.

20. A combination cushion, carry device, and garment apparatus, comprising:

a substantially rectangular flexible planar member formed with a substantially centrally located head opening, having (a) a first surface, made of a first material, (b) a second surface, made of a second material, (c) a top edge, (d) a bottom edge substantially parallel with the top edge, (e) a right edge, and (f) a left edge substantially parallel with the right edge;

a hood attached to the second surface, substantially enclosing the head opening, with a hood attachment system;

a right sleeve, having an interior surface, an exterior surface, and a distal elastic cuff, proximally releasably attached to the first surface with a right sleeve attachment device;

a left sleeve, having an interior surface, an exterior surface, and a distal elastic cuff, proximally releasably attached to the first surface with a left sleeve attachment device;

a waistband retainer, including a right waistband member, a left waistband member, and a waistband adjustment device, attached to the planar member;

a carrying system, including a right carry member, a left carry member, and a carry adjustment device, attached to the planar member; and a pouch, for receiving the planar member when folded, rolled, or bunched, by inverting the pouch, consisting of a substantially rectangular planar body having a first edge, a second edge, a third edge, and a fourth edge, wherein the first edge is attached to the second surface at substantially a midpoint of the top edge, the second edge is attached to the second surface in an orientation that is substantially parallel to the left edge, the third edge is attached to the second surface in an orientation that is substantially parallel to the right edge, and the fourth edge is not attached to the second surface.

* * * * *